United States Patent [19]

Masunaga et al.

[11] 4,069,166

[45] Jan. 17, 1978

[54] ELECTRICAL INSULATING OILS

[75] Inventors: Midori Masunaga, Tokyo; Yoshiki Kohno, Kawasaki; Hiroshi Hasegawa, Yokohama, all of Japan

[73] Assignee: Nippon Oil Company, Ltd., Tokyo, Japan

[21] Appl. No.: 696,249

[22] Filed: June 15, 1976

[30] Foreign Application Priority Data

June 20, 1975 Japan ..... 50-74406
Feb. 12, 1976 Japan ..... 51-13152

[51] Int. Cl.[2] ..... H01B 3/22

[52] U.S. Cl. ..... 252/63; 208/14; 208/19; 252/73

[58] Field of Search ..... 208/14, 19; 252/63

[56] References Cited

U.S. PATENT DOCUMENTS

| | | | |
|---|---|---|---|
| 2,190,918 | 2/1940 | Goethal et al. | 208/19 |
| 3,617,473 | 11/1971 | Lipscomb | 208/14 |
| 3,627,673 | 12/1971 | Sproule et al. | 208/14 |
| 3,657,132 | 4/1972 | Gourlaouen et al. | 252/63 |
| 3,953,319 | 4/1976 | Chesluk et al. | 208/14 |

*Primary Examiner*—Herbert Levine
*Attorney, Agent, or Firm*—Frank J. Jordan

[57] ABSTRACT

An electrical insulating oil having excellent thermal stability and low-temperature properties, which consists essentially of (A) 80–99 parts by weight of refined oil having a low sulphur content and considerable aromatic content and being prepared from a distillate contained in a fraction boiling between 230°–430° C of a paraffin or mixed base crude oil origin, (B) 1–20 parts by weight of a refined oil prepared from a lubricating oil fraction of a mineral oil boiling between 230°–460° C of any crude oil origin and, if desired, (C) 0.001–1.0 part by weight of an essentially ethylene-propylene copolymer as the additive.

13 Claims, No Drawings

ELECTRICAL INSULATING OILS

This invention relates to electrical insulating oils essentially derived from paraffin base crude oils or mixed base crude oils. More particularly it relates to an electrical insulating oil having excellent thermal stability and low-temperature properties, which insulation oil consists essentially of a refined oil obtained by subjecting a mineral oil derived from a paraffin base crude oil or a mixed base crude oil to predetermined refining treatments, a specific refined lubricating oil and, if desired, an amorphous ethylene-propylene copolymer as the additive.

Various insulating oils have heretofore been marketed, and the quantitatively greater part thereof has been of a mineral oil type. The reason for this is that as compared with insulating oils obtained by synthesis, mineral oil type insulating oils may be supplied at a relatively low cost and in large amounts since they are prepared from petroleum fractions as the principal starting material therefor. The synthetic insulating oils have been used only for somewhat particular uses.

On the other hand, the conventional mineral oil type insulating oils are not such that all of them may be produced from any crude oils without substantial difference in quality therebetween as is the case with gasoline or kerosene. In practice, in order to produce a mineral oil type insulating oil, it is the most important to select a crude oil for the insulating oil; more particularly, there have practically been needed, as the crude oils, naphthene base crude oils which have a certain range of specific gravity, flash point and viscosity as well as a low freezing point and a low sulphur content.

Even if such naphthene base crude oils are distilled in attempts to obtain a fraction which is, per se, suitable as an electrical insulating oil, it will be impossible to obtain such a fraction.

Typical processes which have heretofore been known as those for the preparation of electrical insulating oils from naphthene base crude oils, are described hereinbelow.

One known process is one for the preparation of insulating oils by effecting a treatment with sulphuric acid in a specific manner (Japanese Patent Gazette No. 10133/61); however, that process is disadvantageous in that the disposal of used sulphuric acid as waste causes environmental pollution and the yield of insulating oil obtained is low thereby rendering that process unsuitable for industrial use.

Another known process is one for the preparation of insulating oils by hydrofining a mineral oil to the extent that 65 - 96% of the sulphur content thereof has been desulphurized or by mixing the thus hydrofined mineral oil with a mineral oil containing lower aromatic compounds; however, it is seen from the following publication that product oils to be obtained will be greatly degraded in oxidation stability if the mineral oil is otherwise treated with a solvent prior to the hydrofining for desulphurization (Japanese Patent Gazette No. 18584/61).

Still another known process is one which comprises hydrofining a lubricating oil fraction without being treated with a solvent as in the preceding process to the extent that at least 95% of the sulphur content of said fraction is desulphurized and then adding a mineral oil treated with sulphuric acid to the thus hydrofined lubricating oil fraction (Japanese Patent Laying-Open Gazette No. 46199/74).

A further known process is one which comprises hydrogenating a lubricating oil raffinate containing not more than 23 wt.% of aromatic compounds and then adding to the thus hydrogenated raffinate not more than 15 wt.% of a lubricating oil containing larger amounts of aromatic compounds (Japanese Patent Gazette No. 3589/66).

As mentioned above, each of these known processes using naphthene base crude oils as the starting material, per se, discloses a specific process for the preparation of an electrical insulating oil. Because, however, these naphthene base crude oils have been extremely difficult to obtain since the recent petroleum panic, it has been desired to obtain electrical insulating oils from mixed or paraffin base crude oils which are availble at a relatively low cost and in large amounts. Even if, on the other hand, it is attempted to obtain insulating oils from the mixed or paraffin base crude oils by the use of the same process as the usual one for the preparation of insulating oils from the naphthene base crude oils, there will not be obtained insulating oils having satisfactory oxidation stability, hydrogen gas absorbency, corona resistance, pour point and like properties. Therefore, it is necessary to employ a specific different process to obtain insulating oils having such satisfactory properties.

In addition, there has recently been disclosed a process for the preparation of insulating oils having a low pour point from paraffin base crude oils (Japanese Patent Gazette No. 46123/74); however, this known process uses a refined oil containing aromatic compounds in amounts of about 14% at most and may give the insulating oils by the addition of an antioxidant to base oils therefor.

Unlike these known processes, the process according to the present invention uses paraffin or mixed base crude oils which are available in relatively large amounts, in the preparation of the new electrical insulating oils therefrom.

The present inventors had made intensive studies in attempts to clarify how or under what conditions paraffin or mixed base crude oils should be treated to produce therefrom electrical insulating oils having, as their principal properties, oxidation stability, thermal stability, corona resistance, corrosion resistance and low-temperature properties in addition to, as a matter of course, satisfactory electrical properties, these properties being among those required in electrical insulating oils; and, as a result, they have found a reliable process for preparing excellent electrical insulating oils having predetermined properties. Recently, condensers and cables as well as transformers and breakers are thoroughly degased prior to being charged with an insulating oil, after which they are further treated so that they are substantially prevented from contacting air by the use of diaphrams or nitrogen enclosure; therefore, there are few cases where oxygen is present in said electrical appliances. At the present time, it is a tendency that there are sought electrical insulating oils having excellent thermal stability rather than oxidation stability ("Sekiyu Gakkai Shi (Journal of Petroleum Academic Society)" Page 16 and 24, No. 7, Vol. 17, 1974).

The primary object of this invention is to provide an electrical insulating oil having the above-mentioned excellent properties.

The electrical insulating oil of this invention having excellent thermal stability may consist essentially of (A)

80–99 parts by weight of a refined oil (I) containing not more than 0.25 wt.% of sulphur and 18–30 wt.% of aromatic compounds, the refined oil being prepared by refining with a solvent a distillate contained in a fraction having a boiling range of 230°–430° C at atmospheric pressure obtained by distilling a paraffin or mixed base crude oil at atmospheric pressure or distilling at a reduced pressure a bottom oil obtained by the distillation of the crude oil at atmospheric pressure, thereby to obtain a raffinate which is then hydrofined, dewaxed with a solvent and, if desired, treated with a solid adsorbent thus obtaining the refined oil (I) and (B) 1–20 parts by weight of a refined oil (II) having a lower aromatic content than the refined oil (I) and being prepared by treating the lubricating oil fraction of a mineral oil at least with a solid adsorbent, the refined oils (I) and (II) being together mixed in such a manner that the resulting mixed oil or electrical insulating oil contained not higher than 0.35 wt.% of sulphur; the electrical insulating oil of this invention as the base oil may further contain (C) 0.001–1.0 part by weight per 100 parts by weight of said base oil, of an essentially amorphous ethylenepropylene copolymer (III) having a weight average molecular weight of 10,000–200,000 and a propylene content of 10–70 mol%, whereby is obtained a electrical insulating oil having a remarkably low pour point in addition to the excellent properties exhibited by said insulating oil consisting essentially of the oils (I) and (II).

This invention will be further detailed hereinbelow.

First of all, the refined oil (I) contained in the insulating oil of this invention as one of the essential components thereof will be explained hereunder.

The paraffin base crude oil used herein is one containing paraffinic hydrocarbons in large proportions and more particularly the crude oil is such that its first key fraction (kerosene fraction) has an API specific gravity of not smaller than 40° and its second key fraction (lubricating oil fraction boiling at 275°–300° C at a reduced pressure of 40 mm of mercury) has an API specific gravity of not smaller than 30° as is described in "Sekiyu Binran (Handbook on Petroleum)" on page 19, 1972 edition, published by Sekiyu Shunju Co., Ltd., Japan; typical of the paraffin base crude oils are a Pennsylvania crude oil, a Minas crude oil and the like.

The mixed base crude oil used herein is one which is qualitatively intermediate between the paraffin and a naphthene base crude oil and more particularly the mixed base crude oil is such that its first key fraction has an API specific gravity of 33°–40° and its second key fraction an API specific gravity of 20°–30°. Typical of the mixed base crude oils are Midcontinent crude oil and many of Middle East-produced crude oils such as Arabia and Khafji crude oils. In this invention there may preferably be used the Arabia crude oils such as Arabian medium and Arabian light crude oils.

The mineral oil from which the refined oil (I) is prepared is a distillate contained in a fraction having a boiling range of 230°–430° C at atmospheric pressure, the distillate being obtained by distilling a paraffin or mixed base crude oil at atmospheric pressure or by distilling at a reduced pressure a bottom oil obtained by the distillation of the crude oil at atmospheric pressure. The distillate for preparing the refined oil (I) therefrom is one contained in the fraction boiling in the range of 230°–430° C, preferably 250°–400° C; it may preferably be part or the whole of the fraction or it may also contain at least about 80, preferably 90, wt.% of the fraction with the balance being other fractions having a boiling range approximate to that of the former fraction.

The starting mineral oil (derived from the paraffin or mixed base crude oil) for the refined oil (I) is treated with a solvent capable of selective dissolution of aromatic compounds to decrease the amounts of sulphur and other impurities contained in the starting oil. In this case, it is a matter of course that the aromatic compounds in the starting mineral oil also decreased in amount.

The solvents for selectively dissolving the aromatic compounds are usual ones illustrated by furfural, liquefied sulphur dioxide, phenol and the like; among these solvents furfural is particularly preferred. When furfural, for example, is used as the solvent, the extracting temperatures used may be in the range of 50°–100° C, preferably 60°–90° C, and the ratios by volume of furfural to the starting mineral oil may be in the range of 0.3–2.0, preferably 0.5–1.5.

Then the raffinate obtained by the refinement with the solvent is hydrofined and thereafter dewaxed with a suitable solvent to obtain a predetermined pour point on the raffinate so treated. The thus treated raffinate is consecutively treated with clay as required, thereby obtaining the refined oil (I).

The respective operational conditions under which particularly the solvent refining and hydrofining treatments of all the treatments mentioned above are effected, should be determined in combination so that the refined oil (I) to be obtained contains not more than 0.25% by weight of sulphur and 18–30% by weight of aromatic compounds (The content of aromatic compounds expressed herein is intended to mean one in % which is determined by percolating a mineral oil through silica gel). In other words, it is possible to allow the operational condition of each of the solvent treatment and the hydrofining treatment to be widely varied for the purpose of obtaining the refined oil (I) since these operational conditions may be determined in combination with, not independently of, each other for the attainment of said purpose.

The limitation of the refined oil (I) to not more than 0.25 wt.% in sulphur content is based on a consideration that the resulting electrical insulating oil containing the refined oil (I) having such a sulphur content will not have adverse effects on "copper blackening" in transformers which has recently raised a problem. More particularly the present inventors, as a result of their studies on the relationship between the copper blackening and sulphur content, have found that if an electrical insulating oil used contains not more than 0.35 wt.% of sulphur then the amount of sulphur to be deposited on a copper plate employed as the electrode will be remarkably decreased. In the practice of this invention, therefore, the refined oil (I) should be limited to as low as not more than 0.25 wt.% in sulphur content in order to permit the insulating oil containing the refined oil (I), the refined oil (II) and, if desired, (III) the amorphous ethylene-propylene copolymer to keep its corrosion inertness (copper blackening inertness securely satisfactory. The use of the amorphous ethylene-propylene copolymer is particularly effective in the further improvement of the electrical insulating oil in low-temperature properties.

It has also been found by the inventors that the refined oil (I) should be limited to 18–30 wt.% in content of aromatic compounds not only to keep at a satisfactory level its hydrogen gas absorbency which may be an indicator of corona resistance but also to keep its thermal stability excellent. The present inventors have previously found that such a refined oil containing aromatic compounds in amounts of more than 25 wt.% may keep its hydrogen gas absorbency at a satisfactory level and, as a result of their subsequent studies, also found that even such a refined oil containing the aromatic compounds in amounts of 18–30 wt.% may be improved in hydrogen gas absorbency by its viscosity being lowered to a specified level. Thus, when the refined oil (I) is produced to contain the aromatic compounds in amounts of 18–30 wt.%, the viscosity thereof should be in the range of 4–12 cSt (at 30° C), preferably 5–10 cSt (at 30° C). The most preferable content of the aromatic compounds in the refined oil (I) according to this invention is in the range of 22–25 wt.%.

The catalysts which may be used in the hydrofining according to this invention include the oxides of metals of Group VI, Group IB and Group VIII of the Periodic Table, the metal oxides being supported by bauxite, activated carbon, Fuller's earth, diatomaceous earth, zeolite, alumina, silica, silica alumina or the like, as the carrier. These catalysts are usually used after preliminary sulphurization of the catalytic metal portion on the carrier portion. Typical of the metal oxides are cobalt oxide, molybdenum oxide, tungsten oxide and nickel oxide.

In the practice of this invention there may particularly preferably be used a catalyst consisting of nickel and molybdenum oxides supported on an aluminum oxide-containing carrier, the metal oxides having been preliminarily sulphurized. The reaction temperatures in the hydrofining treatment may usually be in the range of about 230° to about 345° C, preferably 260°–320° C. At lower reaction temperatures the reaction rate will be low, while at higher temperatures the oil to be treated will be decomposed whereby the paraffin content is increased, the pour point is somewhat raised and the electrical insulating oil is not desirable in color. The reaction pressures may be at least 25 kg/cm$^2$G, preferably 25–75 kg/cm$^2$G and more preferably 35–45 kg/cm$^2$G. In addition, the amounts of hydrogen contacted with the oil to be hydrofined may be 100–10,000 Nm$^3$/Kl of oil, preferably 200–1,000 Nm$^3$/Kl of oil.

The hydrofining method employed in this invention is one in which hydrogenolysis is very highly inhibited.

As mentioned above, the refined oil (I) which is one essential component of the insulating oil of this invention, is prepared by subjecting the starting mineral oil to the refinement with a solvent and the hydrofining whereby the starting oil is caused to contain aromatic compounds and sulphur each in a predetermined amount. As mentioned later, however, the omission of the refinement with the solvent will remarkably degrade thermal stability in electrical insulating oils being obtained, while the omission of the hydrofining will remarkably degrade oxidation stability, electrical properties, thermal stability and the like in electrical insulating oils being obtained.

The solvent dewaxing according to this invention is to solidify the waxy substance in the oil for removal therefrom by the use of a known method which is usually the BK method in this case. The solvents used herein include a mixed solvent such as benzene-toluene-acetone or benzene-toluene-methyl ethyl ketone. The suitable composition (ratio of ketonic component to aromatic components) of the solvent is about 30–35% for acetone-containing mixed solvents and about 45–50% for methyl ethyl ketone-containing ones.

The ratios of the solvent to the oil being dewaxed may be such that the solvent-added oil fed to a dewaxing filter is kept approximately constant in viscosity. The solvent dewaxing treatment according to this invention may be carried out at any stage, particularly preferably at a stage subsequent to the hydrofining step, in the process for the preparation of the electrical insulating oils. If necessary, the thus dewaxed oil may successively be treated with a solid adsorbent. The solid adsorbent treatment stated herein is intended to mean a treatment by which a mineral oil being treated is contacted with a solid adsorbent such as acid clay, activated clay, Fuller's earth, alumina or silica alumina. The contact is usually effected at about 50°–80° C for about a half hour to several hours. The contact method employed is a percolation, contact or like method.

In the invention, on the other hand, the refined oil (II) produced to contain the aromatic compounds in a smaller amount than the refined oil (I) is added to the refined oil (I) in such amounts that the total sulphur content of the resulting mixture does not exceed 0.35 wt.% and the amount of the refined oil (II) added is in the range of 1–20 wt.% of the mixture, thereby obtaining a desired electrical insulating oil.

The refined oil (II), which is a second essential component of the electrical insulating oil of this invention, is one prepared by treating at least with a solid adsorbent a lubricating oil fraction usually contained in a fraction having a boiling range of about 230°–460° C at atmospheric pressure, the latter fraction being obtained by distilling various crude oils. The lubricating oil fraction is one contained in the fraction boiling at 230°–460° C; it may preferably be part or the whole of the fraction boiling in the range of 230°–460° C or it may also contain at least about 80 wt.% thereof with the balance being other fractions having a boiling range approximate to that of the fraction boiling at 230°–460° C. In the solid adsorbent treatment effected in the preparation of the refined oil (II), there may be used the same operational conditions as used in the preparation of the refined oil (I). If the refined oil (II) is one which has been obtained without treatment with the solid adsorbent, the resulting insulating oil will be unsatisfactory in electrical properties, color, thermal stability and the like.

In the preparation of the refined oil (II), there may be effected singly or jointly a solvent refining (refining with a solvent) treatment, a dewaxing treatment, a sulphuric acid refining (refining with sulphuric acid) treatment and the like, prior to the solid adsorbent treatment. In the invention, it is particularly preferable to effect the solvent refining treatment prior to the solid absorbent refining treatment.

The operational conditions for this solvent refining treatment are the same with those employed in the preparation of the refined oil (I); and the operational conditions for the sulphuric acid refining treatment used in preparing the refined oil (I) is identical with conventional ones used in the sulphuric acid refining treatment of ordinary mineral oils.

Since the amount of the refined oil (II) used is very small as compared with that of the refined oil (I) as mentioned later, such a sulphuric acid refining treatment will not result in the production of waste sulphuric acid in large amounts when the acid refining treatment is effected in the preparation of the refined oil (II); however, it is preferable to employ the aforementioned other refining means than said sulphuric acid refining means. The refined oil (II) should be limited in sulphur content to preferably about 0.1–2 wt.%, more preferably about 0.2–1 wt.%.

As previously mentioned, if the solid adsorbent treatment is to be effected in the preparation of each of the refined oils (I) and (II), the dewaxed hydrofined raffinate for the oil (I) and the lubricating oil fraction for the oil (II) may simultaneously be subjected to said treatment after these materials have been mixed together. Furthermore, the material for the oil (I), that for the oil (II) and the amorphous ethylene-propylene copolymer (III) may also simultaneously be subjected to the solid adsorbent treatment after these materials (I), (II) and (III) have been mixed together.

In one embodiment of this invention, 80–99 parts by weight of the refined oil (I) and 1–20 parts by weight of the refined oil (II) are blended together to obtain a new electrical insulating oil having a total sulphur content of not more than 0.35% by weight.

The use of less than 1 part by weight of the refined oil (II) as one of the essential components will result in the production of an electrical insulating oil which is satisfactory in corrosion inertness (inertness to the corrosion of metals for example), corona resistance and thermal stability but unsatisfactory in oxidation stability, while the use of more than 20 parts by weight of the refined oil (II) will result in producing an electrical insulating oil which is inferior in corrosion inertness and thermal stability.

As mentioned above, the refined oils (I) and (II) may be blended together in specific suitable ratios by weight thereby to obtain desired electrical insulating oils which are satisfactory particularly in thermal stability and also in oxidation stability, corrosion inertness, corona resistance and the like.

The refined oil (II) may preferably be used in amounts of 3–10 parts by weight.

In addition, it is required according to this invention that the total sulphur content of the refined oils (I) and (II) after mixed together should be 0.35 wt.% or less. If the total sulphur content were more than 0.35 wt.% then the resulting electrical insulating oil would be degraded ih corrosion resistance (copper blackening resistance) and would not be suitable for effective practical use. It is preferable that the sulphur content of the electrical insulating oils of this invention be in the range of from about 0.05 to 0.3 wt.%.

In another embodiment of this invention, the aforementioned mixture containing the refined oils (I) and (II) may be mixed with the essentially amorphous ethylene-propylene copolymer (III) as the third component thereby to obtain desired electrical insulating oils which are more excellent in low-temperature properties and also excellent in oxidation stability, thermal stability, corona resistance and corrosion inertness. The electrical insulating oil, as the base oil, of this invention has a depressed pour point by having been dewaxed with a solvent for dewaxing, as mentioned above. It is possible to depress the pour point of an electrical insulating oil to about −27.5° C at best by the use of a conventional dewaxing apparatus, the pour point of −27.5° C being considered as the highest temperature which is agreeable to JIS (Japanese Industrial Standard) C-2320. In view of the use of the conventional dewaxing apparatus, it is economically desirable that the resulting dewaxed insulating oil has a pour point of about −25° C at lowest. This invention eliminates the aforesaid disadvantages and makes it possible to depress the pour points of electrical insulating oils easily and more economically without effecting a solvent dewaxing treatment under strict conditions. In other words, the invention makes it possible to produce easily and more economically an end product having a pour point of not higher than −27.5° C or even an end product having a very low pour point of as low as −40° C or lower which cannot be attained by the conventional solvent dewaxing process.

The pour point depressants which have heretofore been extensively used in the preparation of lubricating oils, are mostly polymethyacrylates. However, these depressants when used in the lubricating oil will, as an advantageous effect, depress it in pour point and will, as disadvantageous side effects, degrade it in water separability, emulsification resistance and electrical properties. They, particularly when used in an electrical insulating oil, will remarkably degrade it in emulsification resistance, this rendering them unsuitable as a pour point depressant for the oil.

The essentially amorphous ethylene-propylene copolymers according to this invention may be added to a mixed oil containing 80–99 parts by weight of the refined oil (I) and 1–20 parts by weight of the refined oil (II), in amounts of 0.001–1.0, preferably 0.01–0.2 parts by weight per 100 parts by weight of the mixed oil; when so added to the mixed oil they will not have thereon any disadvantageeous side effects such as increased emulsifiability, degraded electrical properties, decreased oxidation stability and decreased thermal stability. Unlike conventional pour point depressants, the copolymers according to this invention are featured by the fact that they have no said side effects, this feature being indispensable for electrical insulating oils.

In cases where the ethylene-propylene copolymer is used as the third component in the preparation of the final electrical insulating oil, it is desirable that the base oil for said final oil be lowered to not higher than −15° C in pour point by an ordinary solvent dewaxing treatment in view of the cost of the solvent dewaxing treatment and the effect of the ethylene-propylene copolymer added. The use of the base oil having too high a pour point is undesirable since such a base oil will require a more amount of the ethylene-propylene copolymer added, thereby increasing the resulting insulating oil in viscosity and consequently lowering it in cooling effect which is an important characteristic of an electrical insulating oil.

The amorphous ethylene-propylene copolymer is an oil-soluble one having a weight average molecular weight of 10,000–200,000, preferably 20,000–70,000 and a propylene content of 10–70 mol%, preferably 20–60 mol%. The term "amorphous copolymer" used herein is intended to mean an amorphous copolymer which has some degree of crystallizaton, usually 0–5% and preferably 0–2% of crystallization. Furthermore, the amorphous copolymer should preferably be one having such a relatively narrow distribution of molecular weight as usually not more than 8, particularly preferably not more than 4.

The ethylene-propylene copolymers according to this invention may be prepared by specific known processes. The polymerization for the preparation of the copolymers may be effected by introducing ethylene, propylene and hydrogen gas into a catalyst composition at temperatures ranging from a low temperature to a somewhat elevated temperature (usually about −50° to 50° C) and at pressures ranging from atmospheric pressure to a somewhat pressurized atmosphere (usually about 1 to 20 kg/cm² Absolute), the catalyst composition being obtained by mixing a specific homogenizable, organic solvent-soluble Ziegler-Natta type catalyst with an inert organic solvent. Ethylene and propylene are different in polymerizing reaction rate from each other, and the reaction rate of ethylene is much higher than that of propylene; because of this, the monomeric ratio between ethylene and propylene used does not agree with that between the two contained in the resulting copolymer. It is therefore necessary to pay a careful attention to the monomeric ratio of ethylene to propylene used in order to obtain an ethylene-propylene copolymer having a desired propylene content.

The homogenizable Ziegler-Natta type catalysts which may preferably be used in the preparation of the specific copolymer according to this invention, include coordination catalysts consisting of both a Vanadium compound represented by the general formula $VO(OR)_nX_{3-n}$ wherein X is chlorine, bromine or iodine, R is a residue of hydrocarbons having 1–6 carbon atoms and $n$ is an integer of 0–3, and an organoaluminum halide represented by the general formula $R_1AlX_2$, $R_1R_2AlX$ or $R_1R_2R_3Al_2X_3$ wherein $R_1$, $R_2$ and $R_3$ are a residue of hydrocarbons having 1–20 carbon atoms and may be different from, or identical with, each other. Typical of the organoaluminum halides are diethyl aluminum chloride, diisopropyl aluminum chloride and ethyl aluminum dichloride. The inert organic solvents usually used in the copolymerization include aliphatic and aromatic hydrocarbons with n-hexane, heptane, toluene, xylene and the like being preferred.

This invention will be better understood by the following non-limitative examples for illustration purpose only, in which examples all parts and percentages are by weight unless otherwise specified.

EXAMPLE 1

There was obtained a distillate (boiling range of 240°–385° C at atmospheric pressure, sulphur content of 2.1 wt.% and aromatic content of 39 wt.%) by distilling a Middle East-produced (mixed base) crude oil at atmospheric pressure to recover a bottom oil and then distilling the bottom oil so recovered at a reduced pressure. The distillate so obtained was extracted with furfural in the ratio by volume of 1.4 between furfural and distillate at a temperature of 70°–90° C to obtain a raffinate which is then hydrofined in the presence of an NiO - $MoO_3$ catalyst (NiO : 3.0 wt.%; $MoO_3$: 14.0 wt.%) carried on alumina, at a temperature of 310° C and a hydrogen pressure of 40 kg/cm²G and at a liquid hourly space velocity (LHSV) of 1.0. The reffinate so hydrofined was dewaxed with a benzene-toluene-methyl ethyl ketone solvent in the solvent ratio of 1.6 between the solvent and the hydrofined raffinate and at a cooling temperature of −30° C and was then treated with clay at 70° C for 1 hour, thereby obtaining a refined oil (I) having a pour point of −27.5° C, sulphur content of 0.03 wt.%, aromatic content of 24 wt.% and viscosity at 30° C of 7.26 cSt. The refined oil (I) so obtained was measured for its acid value by the use of an oxidation stability test prescribed in JIS (Japanese Industrial Standard) C 2101 with the result that its acid value was found to be 2.15 mg KOH/g.

The aforementioned distillate obtained by the distillation at the reduced pressure was likewise extracted with furfural in the solvent ratio of 1.6 between the solvent and the distillate used, thereby producing a raffinate which was subjected to the same solvent dewaxing treatment as in the preparation of the refined oil (I) and then subjected to clay treatment at 70° C for an hour whereby a refined oil (II) of this invention having a sulphur content of 0.75 wt.% and aromatic content of 20 wt.%. There were blended together 92 parts by weight of the thus obtained refined oil (I) and 8 parts by weight of the thus obtained refined oil (II) to obtain an electrical insulating oil of this invention having an acid value of 0.27 mgKOH/g as determined by the JIS oxidation stability test.

Three hundred milliliters of the electrical insulating oil so obtained were introduced into a 500-ml glass vessel in which copper electrodes were provided 2 mm apart from each other, and a current application test were conducted at an application of 10 KV to the electrodes and at 100° C in a nitrogen atmosphere for 10 days with the result that the amount of sulphur deposited on the electrodes was found to be only 3.1μg. Furthermore the electrical insulating oil obtained in this Example was tested for its hydrogen gas absorbency which is an indicator of corona resistance, by the method (based on the "Technical report No. 6, the Research Committee of Electrical Insulating Oils of Japan") with a satisfactory result that [(a value obtained after 150 minutes) - (a value obtained after 50 minutes] was −40 mm Oil.

This insulating oil after subjected to a heating test (ASTM D 1934, no catalyst), had a satisfactory dielectric loss tangent of 0.25% (at 80° C) and volume resistivity of $3.6 \times 10^{13}$ Ω- cm (at 80° C).

EXAMPLES 2–5 AND COMPARATIVE 1–3

A bottom oil obtained by distilling Middle-East produced (mixed base) crude oil at atmospheric pressure, was distilled at a reduced pressure of about 40 mmHg to obtain a distillate boiling at 230°–420° C at atmospheric pressure. Portions of the distillate so obtained were subjected to solvent refining (extraction with furfural) and then hydrofining under the different operational conditions as shown in Table 1 and further subjected to solvent dewaxing under the same conditions as Example 1 and then treated with clay at 65°–75° C for 1 hour thereby to obtain desired refined oils (I) - 1 to (I) - 2 and comparative refined oils (I') - 1 to (I') - 2, respectively. Separately, portions of the aforesaid distillate were subjected to solvent refining (extraction with furfural) as required, solvent dewaxing as required and clay treatment under the conditions as shown in Table 1 thereby to obtain desired refined oils (II) - 1 to (II) - 4.

Then the refined oils thus obtained were blended together as shown in Table 2 to obtain desired electrical insulating oils (Examples 2–5) and comparative electrical insulating oils (Comparative example 1–3). Thus desired and comparative insulating oils were tested for their properties, and the results are shown in Table 2.

Table 1

| | Solvent refining | | Hydrofining | | | | | | Properties of refined oil | | |
|---|---|---|---|---|---|---|---|---|---|---|---|
| | Solvent/Oil Ratio (furfural/oil) | Extracting temp. (° C) | Catalyst | Reaction temp. (° C) | Hydrogen pressure (kg/cm²G) | LHSV | De-wax-ing | Clay treat-ment | Sulphur content (wt.%) | Aromatic content (wt.%) | Viscosity at 30° C (cSt) |
| Desired refined oil (I) - 1 | 1.2 | 75 - 95 | NiO—$MoO_3$ type | 320 | 40 | 1.5 | De-ing | Clay treat-ment | 0.09 | 27 | 13.5 |
| " (I) - 2 | 1.4 | 70 - 90 | " | 315 | " | 1.0 | " | " | 0.08 | 23 | 8.05 |
| Comparative refined oil (I') - 1 | 0.8 | 75 - 95 | " | 340 | " | 1.5 | " | " | 0.16 | 33 | 13.6 |
| " (I') - 2 | 1.8 | 70 - 90 | " | 300 | " | 1.5 | " | " | 0.07 | 15 | 7.95 |
| Desired refined oil (II)- 1 | 1.6 | 70 - 95 | | | | | De-wax-ing | Clay treat-ment | 0.70 | 21 | 10.7 |
| " (II) - 2 | 2.0 | " | | | | | " | " | 0.56 | 14 | 10.7 |
| " *1 (II) - 3 | 2.5 | 75 - 95 | | | | | None | " | 0.65 | 20 | 12.3 |
| Desired refined oil (II') - 4 | 1.0 | 70 - 95 | | | | | De-wax-ing | " | 1.0 | 29 | 10.8 |

*1 The same refining procedure as that for the Middle-East produced crude oil was followed except that there was used as the starting oil a lubricating oil raction boiling at 265° - 430° C obtained by distilling a Tia Juana (naphthene base) crude oil at atmospheric pressure.

Table 2

| Examples and Comparative examples | Composition of insulating oil | | | | Properties of insulating oils | | | | | | |
|---|---|---|---|---|---|---|---|---|---|---|---|
| | Refined oil (I) (wt.%) | | Refined oil (II) (wt.%) | | Sulphur (wt.%) | Oxidation stability (JISC 2101) acid number mgKOH/g | Oxidation stability (JISC 2101) Sludge % | Hydrogen gas absorbency (Value for 150 min.) - (Value for 50 min.) mm oil | Current application test: Mount of sulphur deposited on copper test piece (μg) | Thermal stability (ASTMD 1934, No Catalyst) Dielectric loss tangent (80° C,%) | Thermal stability (ASTMD 1934, No Catalyst) Volume resistivity (×10¹²) 80° C,Ωcm |
| Comparative example 1 | (I')-1 | 92 | (II)-1 | 8 | 0.23 | 0.36 | 0.15 | −56 | 6.5 | 0.85 | 6.0 |
| Comparative example 2 | (I)-1 | 92 | (II )-4 | " | 0.17 | 0.35 | 0.14 | −41 | 5.9 | 0.75 | 6.5 |
| Example 2 | " | " | (II)-1 | " | 0.14 | 0.27 | 0.09 | −39 | 3.9 | 0.40 | 23 |
| Example 3 | " | 90 | (II)-2 | 10 | 0.14 | 0.29 | 0.10 | −35 | 3.1 | 0.31 | 28 |
| Example 4 | (I) -2 | " | (II)-1 | " | 0.14 | 0.27 | 0.12 | −29 | 2.8 | 0.22 | 45 |
| Comparative Example 3 | (I')-2 | " | (II)-2 | " | 0.12 | 0.48 | 0.08 | +12 | — | — | — |
| Example 5 | (I)-1 | " | (II)-3 | " | 0.15 | 0.35 | 0.12 | −39 | 3.3 | 0.36 | 25 |

From Comparative example 1 it is seen that if the refined oil (I) used were to contain aromatic compounds in amounts of higher than 30% then the resulting electrical insulating oil would not be a satisfactory one.

From the comparison of Comparative example 2 with Example 2, it is seen that if the refined oil (II) used contained aromatic compounds in more amounts than the refined oil (I) used then the resulting product oil would not be a satisfactory one.

Example 4 indicates that the refined oil (I) will be satisfactory in hydrogen gas absorbency if it has a viscosity of as low as 4–12 cSt even in cases where its aromatic content is less than 25%.

Comparative example 3 indicates that if the refined oil (I) were to contain less than 18% of aromatic compounds then it will not exhibit a satisfactory hydrogen gas absorbency even if it has low viscosity, thus proving it to be unusable.

Example 5 is a case where a refined oil obtained by treating a distillate from a naphthene base crude oil with a solvent was used as the refined oil (II).

EXAMPLE 6 and COMPARATIVE EXAMPLE 4

The electrical insulating oil A as obtained in Example 1 was incorporated with an amorphous ethylene-propylene copolymer having a weight average molecular weight of 45,000 and a propylene content of 37 mol%, in the amount of 0.1 part by weight per 100 parts by weight of the electrical insulating oil, thereby obtaining a desired electrical insulating oil B having further improved low-temperature properties. The properties of the electrical insulating oil B are shown in Table 3.

For comparison, the same electrical insulating oil A as mentioned above was incorporated with polymethacrylate which was a commercially available pour point depressant, in the amount of 0.3 wt.% of the oil A thereby obtaining an electrical insulating oil C the properties of which are also shown in Table 3.

As is seen from Table 3, the polymethacrylate-added electrical insulating oil C as compared with the insulating oil A as a base oil, had a low pour point but had remarkably degraded electrical properties, emulsification resistance and thermal stability. Thus, the oil C was not suitable for use as an electrical insulating oil. In contrast, the ethylene-propylene copolymer-added electrical insulating oil B as compared with the insulating oil A, was low in pour point and excellent in the other properties. The oil B was an excellent electrical insulating oil accordingly.

Table 3

| | Insulating oil A (obtained in Example 1) | Insulating oil B (obtained in Example 6) | Insulating oil C (Comparative example 4) |
|---|---|---|---|
| Pour point (° C) | −27.5 | −42.5 | −42.5 |
| JIS Oxidation stability *1 | | | |
| Sludge (%) | 0.10 | 0.12 | 0.15 |
| Acid number (mgKOH/g) | 0.27 | 0.27 | 0.33 |
| Steam emulsion number *2 (sec) | 41 | 40 | at least 1200 |
| Volume resistivity (80° C, Ω .cm) | $6.1 \times 10^{15}$ | $5.8 \times 10^{15}$ | $0.75 \times 10^{15}$ |
| Dielectric loss tangent (80° C,%) | 0.003 | 0.005 | 0.018 |
| Thermal stability *3 | | | |
| Volume resistivity (80° C, Ω . cm) | $3.6 \times 10^{13}$ | $4.0 \times 10^{13}$ | $0.81 \times 10^{13}$ |
| Dielectric loss tangent (80° C,%) | 0.25 | 0.21 | 0.65 |

Note:
*1 JIS C2101
*2 JIS K2517
*3 ASTM D1934 No catalyst

EXAMPLE 7

The procedure of Example 1 was followed except that a cooling temperature of −20° C was used in substitution for the cooling temperature at which the dewaxing treatments with the solvent were carried out in the preparation of the refined oils (I) and (II) respectively, thereby obtaining an electrical insulating oil D as a base oil. This base oil D was incorporated with 0.05 wt.% of an amorphous ethylene-propylene copolymer having a weight average molecular weight of 30,000 and a propylene content of 50 mol%, thereby obtaining an electrical insulating oil E.

Table 4 shows the properties of the electrical insulating oils D and E. As is clear from Table 4, the addition of the amorphous ethylene-proylene copolymer to the base oil D obtained by being economically dewaxed gave an electrical insulating oil having not only a low pour point but also excellent oxidation stability, electrical properties and emulsification resistance.

Table 4

| | Insulating oil D | Insulating oil E |
|---|---|---|
| Pour point (° C) | −17.5 | −30 |
| JIS Oxidation stability | | |
| Sludge (%) | 0.11 | 0.12 |
| Acid number (mgKOH/g) | 0.35 | 0.34 |
| Steam emulsion number (sec) | 35 | 34 |
| Volume resistivity (80° C,Ω . cm) | $4.5 \times 10^{15}$ | $4.1 \times 10^{15}$ |
| Dielectric loss tangent (80° C,%) | 0.005 | 0.006 |

EXAMPLE 8

The procedure of Example 1 was followed except that a cooling temperature of −25° C was employed in substitution for that as employed in the solvent dewaxing step in the preparation of each of the refined oils (I) and (II), thereby obtaining an electrical insulating oil F. The oil F as a base oil was then incorporated with 0.03 wt.% of an amorphous ethylene-propylene copolymer having a weight average molecular weight of 30,000 and a propylene content of 50 mol%, thereby to obtain an electrical insulating oil G; furthermore, the incorporation of the same base oil F with 0.1 wt.% of the same copolymer gave an electrical insulating oil H.

The properties of these electrical insulating oils are shown in Table 5.

Table 5

| | Insulating oil F | Insulating oil G | Insulating oil H |
|---|---|---|---|
| Pour point (° C) | −22.5 | −30 | −40 |
| JIS Oxidation stability | | | |
| Sludge (%) | 0.10 | — | 0.12 |

Table 5-continued

| | Insulating oil F | Insulating oil G | Insulating oil H |
|---|---|---|---|
| Acid number (mgKOH/g) | 0.31 | — | 0.33 |
| Steam emulsion number (sec) | 38 | — | 39 |
| volume resistivity (80° C,Ω . cm) | $5.8 \times 10^{15}$ | — | $5.6 \times 10^{15}$ |
| Dielectric loss tangent (80° C,%) | 0.004 | — | 0.006 |

What we claim is:

1. An electrical insulating oil consisting essentially of (A) 80–99 parts by weight of a refined oil (I) containing not more than 0.25 wt.% of sulphur and 18–30 wt.% of aromatic compounds, the refined oil (I) being produced by the steps of:

refining with a solvent capable of selectively dissolving aromatic compounds a distillate contained in a fraction having a boiling range of 230°–430° C at atmospheric pressure obtained by the distillation of a paraffin or mixed base crude oil at atmospheric pressure or the distillation at a reduced pressure of a bottom oil obtained by the distillation of the crude oil at atmospheric pressure thereby to obtain a raffinate from said distillate, hydrofining the raffinate so obtained and dewaxing the thus hydrofined raffinate with a solvent, and (B) 1–20 parts by weight of a refined oil (II) having an aromatic content of 14 to 29% and lower than that of the refined oil (I), the refined oil (II) being prepared by treating at least with a solid adsorbent a lubricating oil fraction of a mineral oil having a boiling range of 230°–460° C at atmospheric pressure obtained from a crude oil, to obtain the electrical insulating oil having a total sulphur content of not more than 0.35 wt.% and excellent thermal stability.

2. An electrical insulating oil according to claim 1, wherein the refined oil (I) is further treated with a solid adsorbent.

3. An electrical insulating oil consisting essentially of (A) 80–99 parts by weight of a refined oil (I) containing not more than 0.25 wt.% of sulphur and 18–30 wt.% of aromatic compounds, the refined oil (I) being produced by the steps of:

refining with a solvent capable of selectively dissolving aromatic compounds a distillate contained in a fraction having a boiling range of 230°–430° C at atmospheric pressure obtained by the distillation of a paraffin or mixed base crude oil at atmospheric pressure or the distillation at a reduced pressure of a bottom oil obtained by the distillation of the crude oil at atmospheric pressure thereby to obtain a raffinate from said distillate, hydrofining the raffinate so obtained and dewaxing the thus hydrofined raffinate with a solvent, and (B) 1–20 parts by weight of a refined oil (II) having an aromatic content of 14 to 29% and lower than that of the refined oil (I), the refined oil (II) being prepared by treating at least with a solid adsorbent a lubricating oil fraction of a mineral oil having a boiling range of 230°–460° C at atmospheric pressure obtained from a crude oil thereby to obtain a base oil for the electrical insulating oil, the base oil having a total sulphur content of not more than 0.35 wt.%, and (C) 0.001–1.0 part by weight per 100 parts by weight of said base oil, of an essentially amorphous ethylene-propylene copolymer (III) having a weight average molecular weight of 10,000–200,000 and a propylene content of 10–70 mol%, whereby is obtained the electrical insulating oil having an excellently low pour point as well as excellent, thermal stability.

4. An electrical insulating oil according to claim 3, wherein the refined oil (I) is further treated with a solid adsorbent.

5. An electrical insulating oil according to claim 1, wherein the solvent capable of selectively dissolving aromatic compounds is a member selected from the group consisting of furfural, liquefied sulphur dioxide and phenol.

6. An electrical insulating oil according to claim 1, wherein the hydrofining is effected at temperatures of about 230° to about 345° C and pressures of at least 25 kg/cm²G in the presence of a catalyst selected from the group consisting of the oxides of metals of Groups VI, IB and VIII, the catalyst being usually sulphurized prior to its use and supported on a carrier selected from the group consisting of bauxite, activated carbon, Fuller's earth, diatomaceous earth, zeolite, alumina, silica and silica alumina.

7. An electrical insulating oil according to claim 1, wherein the solvent for dewaxing is a member selected from the group consisting of a benzene-acetone mixed solvent and a benzene-toluene-methyl ethyl ketone mixed solvent.

8. An electrical insulating oil according to claim 2, wherein the solid adsorbent is a member selected from the group consisting of acid clay, activated clay, Fuller's earth, alumina and silica alumina.

9. An electrical insulating oil according to claim 3, wherein the solvent capable of selectively dissolving aromatic compounds is a member selected from the group consisting of furfural, liquefied sulphur dioxide and phenol.

10. An electrical insulating oil according to claim 3, wherein the hydrofining is effected at temperatures of about 230° to about 345° C and pressures of at least 25 kg/cm²G in the presence of a catalyst selected from the group consisting of the oxides of metals of Groups VI, IB and VIII, the catalyst being usually sulphurized prior to its use and supported on a carrier selected from the group consisting of bauxite, activated carbon, Fuller's earth, diatomaceous earth, zeolite, alumina, silica and silica alumina.

11. An electrical insulating oil according to claim 3, wherein the solvent for dewaxing is a member selected from the group consisting of a benzene-toluene-acetone mixed solvent and a benzene-toluene-methyl ethyl ketone mixed solvent.

12. An electrical insulating oil according to claim 4, wherein the solid adsorbent is a member selected from the group consisting of acid clay, activated clay, Fuller's earth, alumina and silica alumina.

13. An electrical insulating oil according to claim 3, wherein the amorphous ethylene-propylene copolymer is one prepared by introducing ethylene, propylene and hydrogen gases through a homogenizable Ziegler-Natta type catalyst at temperatures usually from about −50° to about 50° C and pressures usually from about 1 to about 20 kg/cm² Absolute.

* * * * *